United States Patent [19]

Saunders et al.

[11] 4,004,791

[45] Jan. 25, 1977

[54] PRESHAPED BLAST FURNACE HEARTH CONSTRUCTION

[75] Inventors: Leonard M. Saunders, Pine Township, Allegheny County, Pa.; Earl W. Sieger, Bayvillage, Ohio

[73] Assignee: United States Steel Corporation, Pittsburgh, Pa.

[22] Filed: Mar. 17, 1976

[21] Appl. No.: 667,789

[52] U.S. Cl. ..... 266/197; 266/283

[51] Int. Cl.[2] ..... C21B 7/06

[58] Field of Search ..... 266/197, 198, 280–286

[56] References Cited

UNITED STATES PATENTS 740,360 9/1903 Hannes ..... 266/197

*Primary Examiner*—Gerald A. Dost

*Attorney, Agent, or Firm*—Walter P. Wood

[57] ABSTRACT

A blast furnace hearth constructed of carbon blocks and having an initially dished upper face. The hearth includes a plurality of courses of full carbon beams and a plurality of courses of stub carbon beams. Each course of the latter extends from the outer wall toward the center of the furnace, and the stub beams of each course are progressively shorter from the lowermost upwardly. The hearth provides longer life without requiring proportionately as much carbon as a flat hearth of equivalent life.

4 Claims, 7 Drawing Figures

FIG. 2.
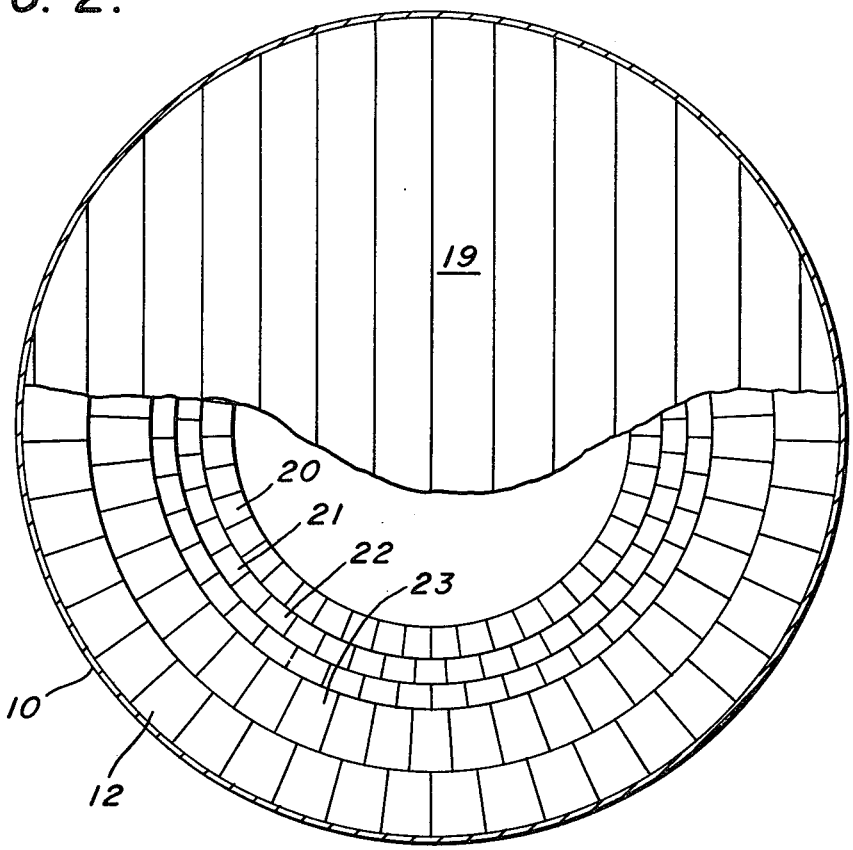
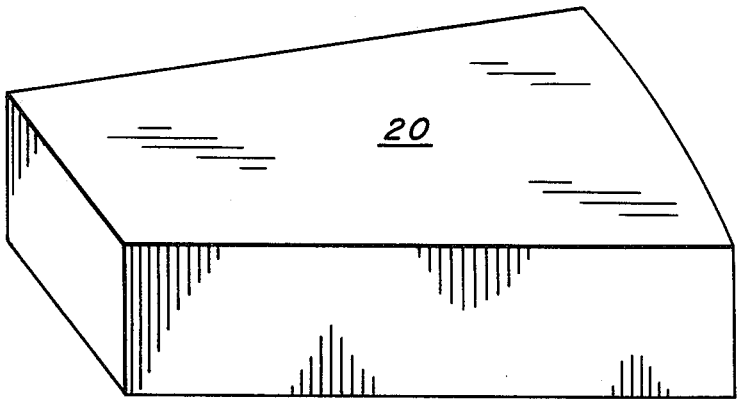
FIG. 3.

PRESHAPED BLAST FURNACE HEARTH CONSTRUCTION

This invention relates to an improved blast furnace hearth constructed of carbon blocks.

A blast furnace hearth rests on a concrete foundation and its upper face is exposed to molten iron produced in the furnace. The useful life of a hearth is a function of its thickness. Conventional hearths are built either of ceramic refractories or carbon blocks. A carbon hearth has a substantially longer life than a ceramic hearth of the same thickness, but its initial cost is greater. In a 32-foot inside diameter furnace a ceramic hearth commonly has a thickness of 180 inches initially and may be expected to last through about 6 to 7 years of actual service. The recommended minimum thickness of a carbon hearth is about one-fourth the inside diameter of the furnace. In a 32-foot inside diameter furnace a 90-inch thick carbon hearth lasts approximately as long as a 180-inch ceramic hearth. Of course the life of a carbon hearth can be prolonged simply by increasing its thickness. Carbon hearths of a thickness of 130 to 140 inches are used to good advantage, but it is not economically justified to build them much thicker.

In service the hearth progressively erodes at its upper face, which gradually becomes dished. As the mid portion of the hearth becomes thinner, more heat is conducted through the hearth to the foundation below. When a carbon hearth erodes to a thickness less than about 24 inches at its mid portion, the hearth conducts so much heat to the concrete foundation that the temperature of the latter rises to about 1300° F. At this temperature calcination of limestone aggregate starts and subsequent deterioration of the foundation occurs. Overheating of the foundation can be forestalled by circulating water through pipes embedded between the foundation and hearth, but the minimum acceptable thickness of a carbon hearth still is considered to be about 24 inches.

An object of the present invention is to provide a carbon hearth which affords longer life without requiring a quantity of carbon commensurate with the quantity needed to obtain an equivalent life simply by increasing the hearth thickness.

A more specific object is to provide a carbon hearth of an initially dished contour by use of a proportionately small quantity of additional carbon, yet obtain a life equivalent to that of a flat hearth of greater thickness. In the drawings:

FIG. 2 is a diagrammatic top plan view, with parts broken away, of the hearth shown in FIG. 1;

FIG. 3 is a perspective view of one of the stub beams embodied in the hearth;

Figure 1:
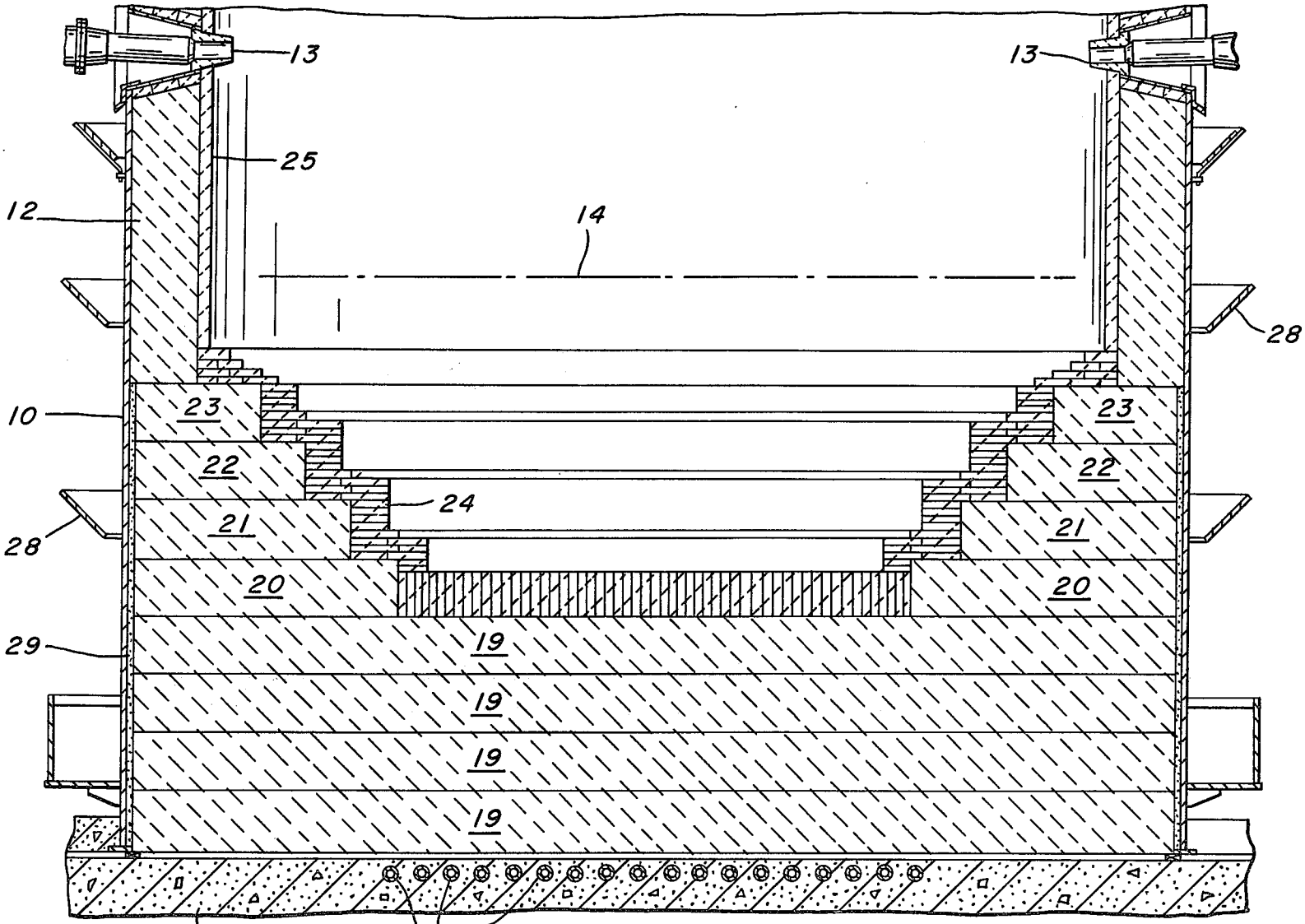
FIG. 1 is a vertical section of a blast furnace hearth constructed in accordance with our invention.

FIG. 1 shows the hearth portion of a blast furnace which may be conventional apart from our novel hearth construction. The furnace has a metal shell 10, a carbon brick hearth wall 12, and tuyeres 13. The hearth wall extends to the bottom of the bosh. The horizontal center line of the iron notch is indicated at 14. The furnace rests on a concrete foundation 15.

In accordance with our invention, the hearth includes a plurality of courses of full carbon beams 19 and a plurality of courses of stub carbon beams 20, 21, 22 and 23. The hearth illustrated has four courses of full carbon beams and a like number of courses of stub beams, conveniently each of a standard thickness 22½ inches, but this may vary. As shown in FIG. 2, the full course beams are placed straight across the furnace. Their ends, and the sides of two of them, are cut to match the curvature of the shell 10. The courses of stub beams extend inwardly from the shell toward the center of the furnace, and the beams of each course are progressively shorter from the lowermost upwardly. FIG. 3 shows one of the stub beams in perspective. Thus the stub beams provide a dished contour to the upper face of the hearth. Preferably we lay a covering 24 of fire clay bricks over the carbon hearth to prevent the carbon from spalling, as might be caused by thermal shock when the furnace is first blown in. Similarly we place a buffer 25 of fire clay bricks over the carbon lining 12.

As is conventional in carbon hearth furnaces, water continuously cascades over the outside of the shell 10 to cool the shell and hearth. Water troughs are indicated at 28. A layer 29 of carbonaceous paste is tamped between the shell and the ends of the carbon beams to conduct heat to the shell and thus cool the beams. Preferably we embed water pipes 30 in the foundation 15 a short distance below the upper surface. Water may be circulated through these pipes to protect the foundation against thermal deterioration. The pipes are not needed to provide the hearth life obtained by use of the invention.

Figure 4:
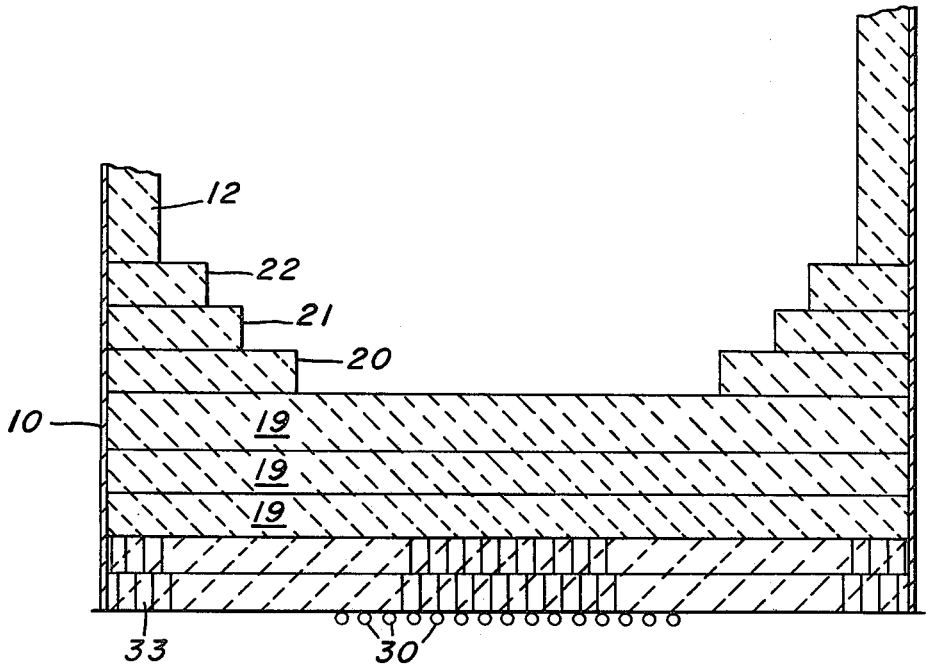
FIG. 4 is a diagrammatic vertical section of a modified hearth constructed in accordance with our invention.

FIG. 4 shows a modification in which we place two courses 33 of ceramic bricks between the foundation 15 and the lowermost course 19 of carbon beams. In this modification we use only three courses of full carbon beams, and three courses 21, 22 and 23 of stub carbon beams. The upper face of the hearth again has a dished contour.

Figure 5:
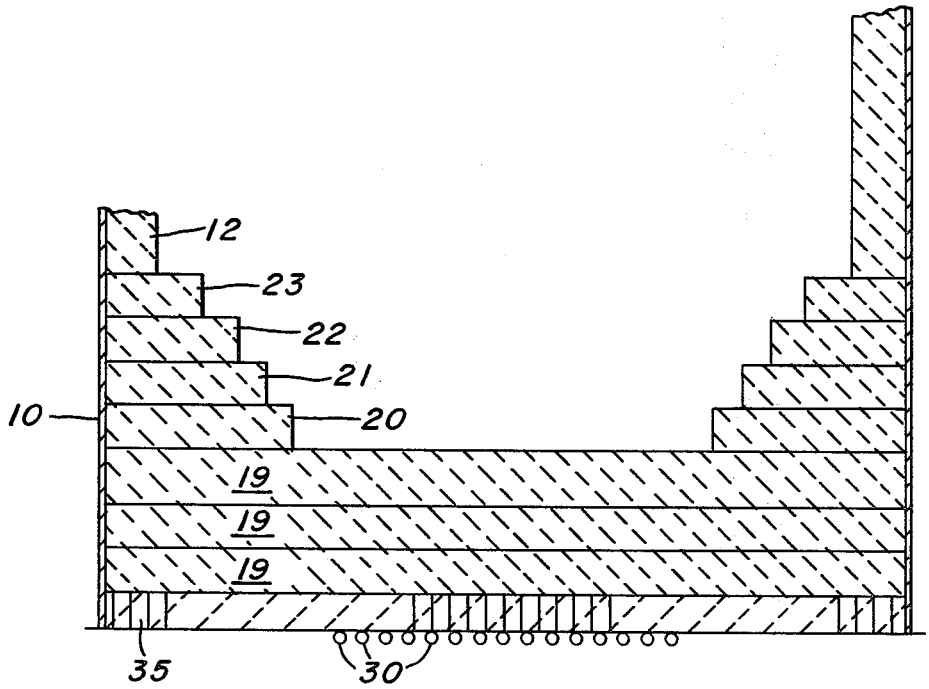
FIG. 5 is a diagrammatic vertical section of another modified hearth constructed in accordance with our invention.

FIG. 5 shows another modification in which we place a single course 35 of ceramic bricks between the foundation 15 and the lowermost course 19 of carbon beams. In this modification we again use only three courses of full carbon beams, but we use four courses 20, 21, 22 and 23 of stub carbon beams to obtain a dished contour.

Figure 6:
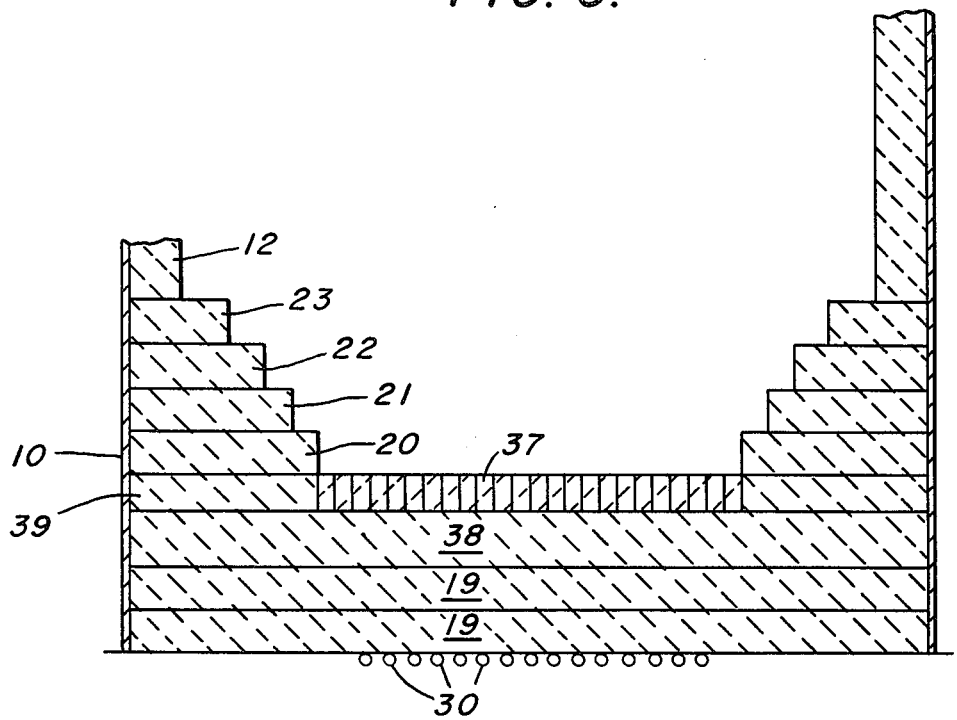
FIG. 6 is a diagrammatic vertical section of still another modified hearth constructed in accordance with our invention.

FIG. 6 shows still another modification in which we place a course 37 of ceramic blocks over the top of the dished hearth. In this modification we use two courses 19 of 22½ inches full carbon beams, one course 38 of 28½ inches full carbon beams, one course 39 of 18 inches stub carbon beams at the level of the ceramic blocks 37, and four courses 20, 21, 22 and 23 of stub carbon blocks.

Figure 7:
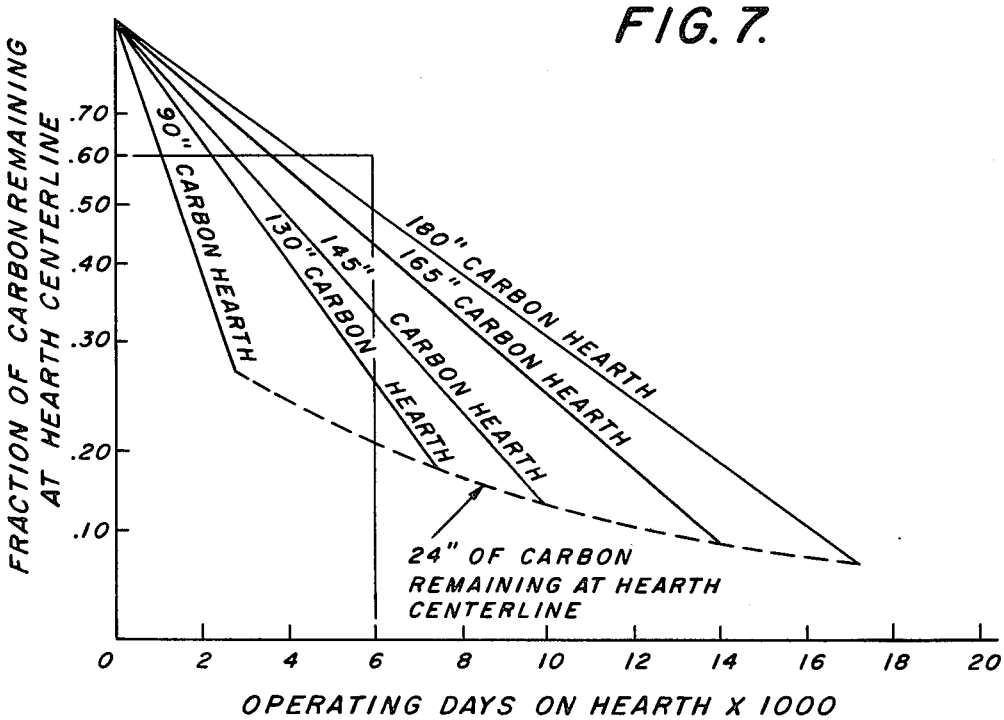
FIG. 7 is a set of curves showing the rate of erosion and the life expectancy of carbon hearths of different thickness.

FIG. 7 shows graphically the fraction of the thickness of carbon remaining at the center line of the hearth plotted on a logarithmic scale against the number of operating days expected for five different initial thickness of carbon hearth. In each instance the hearth is not cooled from beneath. If water is circulated through pipes embedded in the foundation as shown in FIG. 1, the slight cooling of the hearth which results has no appreciable effect on hearth life. The dotted line curve intersecting the solid line curves represents the end of useful life of the hearths, that is, when the carbon has eroded to a thickness of 24 inches. A hearth 90 inches thick and having a conventional flat upper face has an expected life of about 3000 operating days, or about 8 years. A hearth 180 inches thick and having a conventional flat upper face has an expected life of over 17,000 operating days or about 50 years, but this is not justified economically.

In the form of the invention shown in FIG. 1, if the upper surface of the uppermost course 23 of stub beams is taken as the initial upper face of the hearth, the hearth may be considered as having an initial thickness of 180 inches. When a 180-inch flat hearth erodes in service, it acquires a dished upper face of a contour approaching the initial contour of the hearth shown in FIG. 1. Hence the hearth shown in FIG. 1 is equivalent to a 180-inch thick flat hearth eroded to half its initial thickness, that is, with 90 inches of carbon remaining at the center line. By referring to FIG. 7, it is seen that a 180-inch thick hearth reaches this stage of erosion after about 6000 operating days, and that is has over 11,000 operating days remaining expected useful life, or about 30 years. A 145-inch flat hearth has an expected useful life of only 10,000 operating days. Hence the form of the invention shown in FIG. 1 sacrifices only 6000 operating days compared with a 180-inch flat hearth, but it can be expected to give a longer life than a 145-inch flat hearth, and it uses only about the same quantity of carbon.

Presently we consider the form of invention shown in FIG. 1 the best mode of practicing our invention. It should be understood that the specific dimensions stated in the description of this form are only for purposes of illustration, and that actual dimensions can be different as long as the same approximate relation is observed. We have estimated the useful lives of the forms shown in FIGS. 4, 5 and 6 as 17.7 years, 23 years, and 28 years respectively. These forms are less costly, since ceramic refractory replaces some of the carbon, but their expected lives are proportionately shortened.

From the foregoing description it is seen that our invention affords a carbon hearth of long useful life without the need for a proportionately increased quantity of carbon. By initially constructing the hearth with a dished upper face, we achieve substantially longer life as against a flat hearth of equivalent carbon content.

We claim:

1. In a blast furnace hearth constructed of carbon blocks and having a dished upper face, the improvement in which said hearth comprises a plurality of courses of full carbon beams, and a plurality of courses of stub carbon beams overlying the uppermost course of full carbon beams, the courses of stub beams being progressively shorter from the lowermost upwardly and extending inwardly from the hearth wall toward the center of the furnace.

2. An improvement as defined in claim 1 in which there are four courses of full carbon beams and four courses of stub carbon beams.

3. An improvement as defined in claim 1 in which the hearth is the equivalent of a hearth having an initial thickness of 180 inches but eroded to about half its initial thickness at the hearth centerline.

4. An improvement as defined in claim 1 in which said hearth includes at least one course of ceramic refractory.

* * * * *